US008399060B2

(12) United States Patent
Rule

(10) Patent No.: US 8,399,060 B2
(45) Date of Patent: Mar. 19, 2013

(54) METHOD FOR FABRICATING ENVIRONMENTALLY FRIENDLY SHAKES

(75) Inventor: Kenneth Rule, Atlanta, GA (US)

(73) Assignee: LifePine Products, LLC, Atlanta, GA (US)

( * ) Notice: Subject to any disclaimer, the term of this patent is extended or adjusted under 35 U.S.C. 154(b) by 1003 days.

(21) Appl. No.: 12/426,408

(22) Filed: Apr. 20, 2009

(65) Prior Publication Data

US 2010/0263322 A1 Oct. 21, 2010

(51) Int. Cl.
*B05D 3/00* (2006.01)

(52) U.S. Cl. ..... 427/291

(58) Field of Classification Search ..... 427/291
See application file for complete search history.

(56) References Cited

U.S. PATENT DOCUMENTS

| | | | | |
|---|---|---|---|---|
| 1,593,800 | A | 7/1926 | King | |
| 1,683,751 | A | 9/1928 | Abbott | |
| 1,704,412 | A | 3/1929 | Tracy | |
| 1,780,097 | A | 10/1930 | Putman | |
| 1,910,895 | A | 5/1933 | Gilmer | |
| 3,207,192 | A | 9/1965 | Dennison | |
| 3,642,042 | A | 2/1972 | Davidson et al. | |
| 3,717,450 | A | 2/1973 | Loughridge et al. | |
| 4,291,601 | A | 9/1981 | Guynup | |
| 4,325,421 | A | 4/1982 | Janovick et al. | |
| 4,486,475 | A | 12/1984 | Shutov et al. | |
| 4,586,612 | A * | 5/1986 | Oberg | 209/555 |
| 4,971,125 | A * | 11/1990 | Rule | 144/380 |
| 5,562,956 | A | 10/1996 | White, Jr. | |
| 6,162,496 | A | 12/2000 | Blue | |
| 6,207,228 | B1 | 3/2001 | Hundt et al. | |
| 6,418,990 | B1 | 7/2002 | Lindstrom | |
| 6,517,232 | B1 | 2/2003 | Blue | |
| 6,536,939 | B1 | 3/2003 | Blue | |
| 6,551,655 | B2 | 4/2003 | White et al. | |
| 7,258,922 | B2 | 8/2007 | Hesse et al. | |
| 7,347,232 | B2 | 3/2008 | Edwards | |
| 7,381,271 | B2 | 6/2008 | Farmwald et al. | |
| 2004/0250912 | A1 * | 12/2004 | Haller et al. | 144/345 |

OTHER PUBLICATIONS

Cox Industries, Cox Responds to Market Confusiono Over Treatment Chemicals, Oct. 2, 2008, pp. 1-3.*
DuraPine by Cox Advertisement.
Cox Industries, Cox Responds to Market Confusion Over Treatment Chemicals, Oct. 2, 2008.
Cox Material Safety Data Sheet, Wolmanized and/or DuraPine Residential Treated Wood, Sep. 4, 2008.
Arch Treatment Technologies, 2008, Product Guide: Wolmanized Residential Outdoor Wood.
Cox Industries, Product Guide: DuraPine by Cox.

*Primary Examiner* — Kelly M Gambetta
(74) *Attorney, Agent, or Firm* — Pitts & Lake, P.C.

(57) ABSTRACT

A shake fabricating process for producing roofing shakes from a lumber drop block having a natural grain and having an upper surface and an opposed lower surface is provided. In accordance with the process, the drop block is scanned for unacceptable grain structure. The drop block is cut across said natural grain into blanks having a length generally equivalent to the length of a roofing shake and including a first end section and a second end section. The blank is cut on a diagonal plane relative to the first and second end sections, the plane extending from the first end to said second end so as to divide the board into a pair of shakes, each shake having a first and second end portion and defining a decreasing thickness from the first end portion to the second end portion. The shakes are placed in a pressure treating chamber for treatment with a chemical preservative.

12 Claims, 2 Drawing Sheets

METHOD FOR FABRICATING ENVIRONMENTALLY FRIENDLY SHAKES

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

This invention relates to a process for fabricating roofing shakes from lumber byproducts and treating such shakes in an environmentally-friendly manner and increase the useful life by 400%. In this particular invention wedge shaped shakes are cut from recycled wood and pressure-treated with a preservative containing no heavy metals or harmful pesticides.

SUMMARY OF THE INVENTION

For over two centuries, Old Growth Western Red Cedar trees have been harvested as the primary source of raw material in the production of wood roofing shakes. With the extremely long growth cycle of Western Red Cedar requiring up to 600 years to reach maturity, and a minimum of 150 to 200 years to be a suitable raw material for the production of roofing shakes, the supply of available trees has dwindled significantly. The factor coupled with the growing environmental concerns and resulting bans on cutting the old growth forests has driven the cost up to a level where the production of naturally rot resistant cedar shakes is no longer economically feasible in the United States. Shake production has shifted to Canada where limits on harvesting these ancient trees is less stringent. As a result, alternative domestic wood species have been employed in the production of wood roofing shakes. However, much difficulty has been encountered in finding naturally rot resistant species that produce the same attractive grain texture and coloration of Western Red Cedar and there has been very little market acceptance of these alternative products.

Cedar shakes provide a rustic-looking roofing material and are resistant to weather and insect deterioration. Old Growth Heartwood Cedar naturally contains preservatives and a closed cell structure which aid in the prevention of deterioration. However, more commonly available woods, such as Southern Yellow Pine (SYP), do not contain such natural characteristics.

Over the years the supply of cedar has been greatly reduced, and that which is available tends to be expensive and is often of poor quality and has a decreased useful life prior to required replacement. Where alternative woods have been utilized the desirable appearance of cedar has been sacrificed. Accordingly, in order to provide a term of use of up to 50 years, the pine must be treated with a chemical preservative. In the past, most of the preservatives have included chrome and arsenic and large amounts of copper, of which chrome and arsenic are no longer acceptable environmentally. Also, many of these prior chemical preservatives discolored the wood and required additional step of re-pigmenting the wood to a natural wood color. Thus, difficulty has been encountered in reproducing both the surface texture and the colorization of cedar where alternative woods are used.

In the recent past and with the protection of old growth cedar forests, only younger cedar trees have been harvested. This cedar does not possess the natural preservative characteristics of the Old Growth trees and must also be treated with preservatives to be commercially viable. Both cedar and the alternative species such as SYP have been treated with a preservative containing chrome, arsenic and copper (CCA). With cedar, the effectiveness of CCA treatment is limited because of the closed cell structure causing a lack of penetration of the preservative into the wood. In SYP, the treatment is very effective. However, the green color created could not be overcome with pigments at a cost that is commercially viable. Both products also faced market resistance due to the increasing environmental concerns and eventual elimination of the CCA as a preservative for residential building materials.

Therefore, it is an object of the present invention to provide an economical shake fabricating process which produces roofing shakes from recycled wood, a common waste product from the production of lumber.

It is a further object of the present invention to provide a shake fabricating process, for treating the shakes with environmentally-friendly preservatives to provide a prolonged life.

Yet another object of the present invention is to provide a shake fabricating process which produces durable shakes efficiently and at a reasonable cost.

Other objects and advantages will be accomplished by the present invention which provides a shake fabricating process for producing roofing shakes from recycled wood.

In accordance with the process of lumber production, a log is stripped of its bark and cut into boards ranging in size from 2×4 to 2×12 dimension lumber. The boards are scanned for defects and trimmed to maximize the grade of the lumber to either #1 or #2 grades. (Building codes generally allow only #1 and #2 grades to be used in building construction for structural elements such as floor joists, rafters and wall studs.) This process is referred to as "grade optimization."

In most cases, defects, such as splits and knots, identified in the scanning process are removed in 2-foot, 4-foot or 6-foot sections because standard lumber lengths are in multiples of two feet. These removed inferior sections are referred to as "drop blocks," a lumber by-product. It has been a standard practice in the lumber industry to merely grind up the drop blocks for heating boilers or paper pulp.

In accordance with the present invention the drop blocks are graded for acceptable grain structure for shakes. The acceptable drop blocks are cut to blanks of pre-selected length corresponding to the desired length of the shakes to be produced. The blanks are then grooved on opposing sides to simulate weathered wood grain and in a manner and depth to provide lateral stability to the wood. Each blank is then split down the center of the natural grain, i.e. the growth rings, to create a vertical grain blank, which is then cut on a diagonal to create a tapered shake.

The tapered shakes are then packaged on pallets which are pressure-treated with an environmentally-friendly chemical preservative and allowed to drain and dry.

BRIEF DESCRIPTION OF THE DRAWINGS

The above-mentioned features of the present invention will become more clearly understood from the following detailed description of the invention read together with the drawings in which.

DETAILED DESCRIPTION OF THE INVENTION

Figure 1:
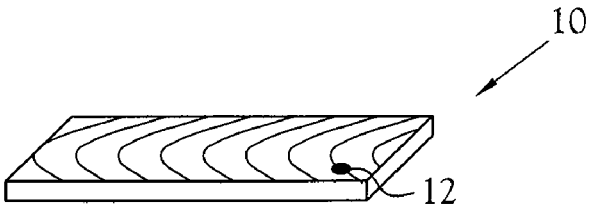
FIG. 1 is a perspective view of a drop block used in the process of the present invention.
Figure 2:
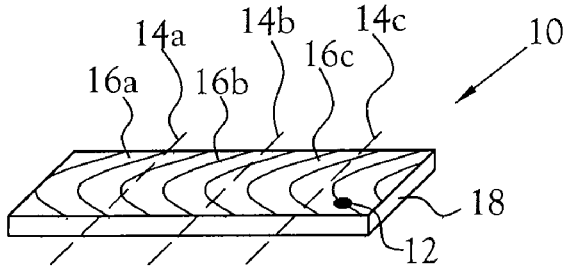
FIG. 2 is a perspective view of drop block sized and trimmed to form blanks in the process of the present invention.

Various steps of a preferred application of the shake fabricating process of the present invention are in FIGS. 1-7. The process utilizes lumber drop blocks as a basic material for fabricating the shakes, and an environmentally-friendly chemical wood preservative is infused into the shakes. In one specific application of the process the wood utilized is pine. It will, however, be recognized that various types of wood can be used and that various pigments may be used depending on the shake color desired.

Referring now to the drawings and in accordance with a preferred application of the process, a drop block 10 contains an unacceptable large knot 12. The drop block 10 is then cut along lines 14*a*, 14*b* and 14*c* into blanks 16*a*, 16*b*, and 16*c* and scrap piece 18 containing the unacceptably large knot 12. Each of the blanks 16*a*, 16*b* and 16*c* is treated in a similar manner, so that only the treatment of blank 16*a* will be described in detail.

Figure 3A:
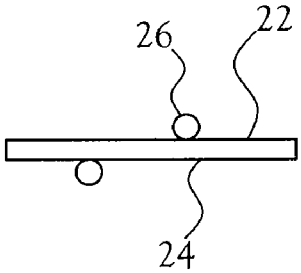
FIG. 3A is a diagrammatic illustration of the step of graining the blank in accordance with the present invention.
Figure 3B:
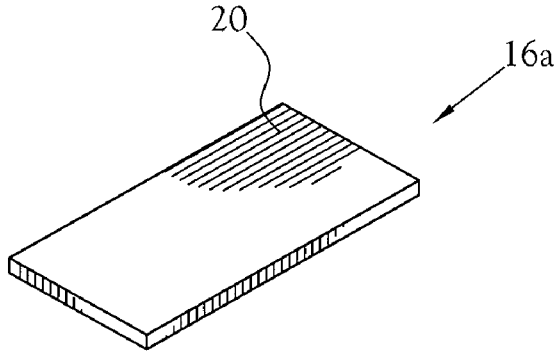
FIG. 3B is a perspective view of a grained blank.
Figure 4:
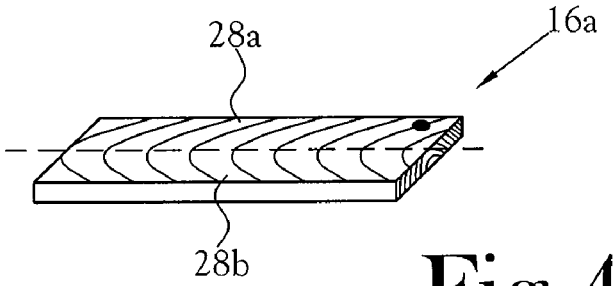
FIG. 4 is a perspective view of a grained blank with an indicated split line.
Figure 5A:
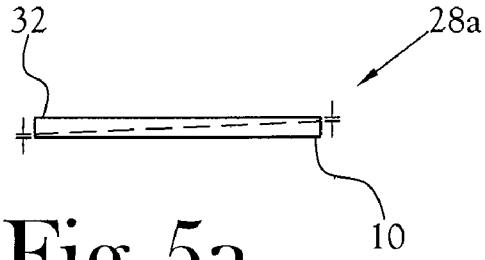
FIG. 5A is an elevation view of a vertical grain blank with an indicated saw line for forming tapered shakes.
Figure 5B:
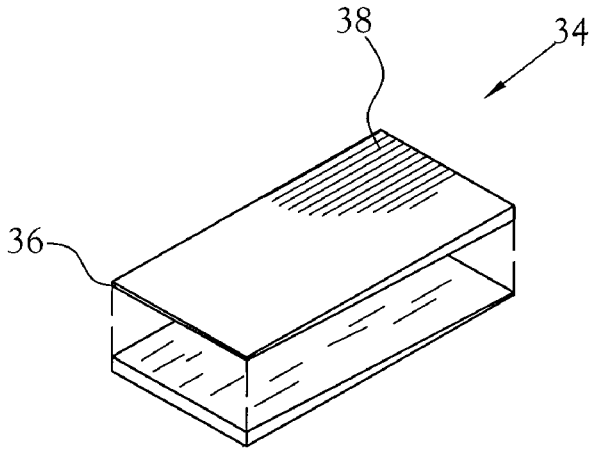
FIG. 5B is a perspective view of the separated, tapered shakes of FIG. 5A.
Figure 6:
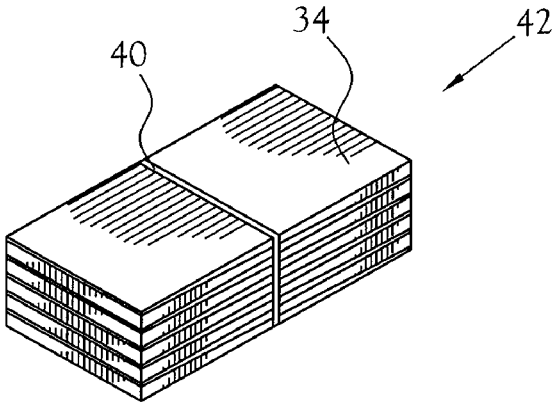
FIG. 6 is a perspective view of a bundled package of shakes formed in accordance with the present invention.
Figure 7:
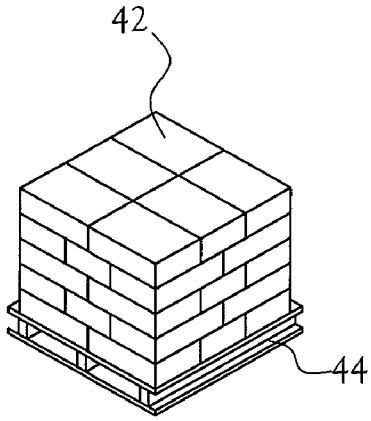
FIG. 7 is a perspective view of a pallet carrying a plurality of bundles of shakes for pressure treatment with an environmentally-friendly preservative.

As illustrated at in FIG. 3A, the next step in the preferred process is the cutting of longitudinal grooves 20 in both the upper and lower surfaces 22 and 24, respectively, of the blanks 22 to give the surfaces the appearance of weathered wood grain. This can be accomplished using a surfacer 26 having uneven blades. The blank 16*a* is then cut longitudinally along the natural grain defined by growth rings to form two vertical grain blanks 28*a* and 28*b*. Each of the vertical grain blanks is then the diagonally from its first end 30 to its opposed second end 32, as illustrated in FIG. 5*a*, to produce a pair of shakes 34 defining decreasing thicknesses from their first end portions 36 to their second end portions 56. It will be noted that the diagonal cut is made such that the end portions 56 define a thickness 58 sufficient to provide the requisite durability, the preferred thickness being approximately one eighth of an inch.

The shakes are then stacked in an alternating lengthwise pattern and bundled with a strap 40. The bundles 42 are stacked on a pallet 44 for insertion into a pressurized chamber. The shakes are then pressure treated with one or more environmentally-friendly chemical wood preservatives, the preservatives serving to extend the useful life of the shakes. In a preferred embodiment of the present invention, the chemical preservative comprises copper azole blended with dissolved copper. After pressure treatment of the shake with preservatives the shakes are allowed to drain and dry, then removed from the chamber for shipment and/or sale.

In light of the above it will be recognized that the process of the present invention produces a shake which has the appearance of a traditional hand hewn or hand split shake, and ages uniformly and bleaches to a natural wood color. Further, the process for efficient use the fabricating materials with very little waste, and inexpensively produces strong, durable shakes.

Use of 100% recycled wood eliminates primary log processes and kiln drying of shakes prior to treatment. The process uses an environmentally friendly preservative and eliminates the need for addition of a pigment. By recycling processed lumber, there is a substantial decrease in environmental impact by elimination of logging to provide raw material. By using recycled wood there is a major decrease in energy consumption to manufacture shakes by eliminating the logging processes, the saw mill processes and the need to kiln dry the wood prior to treatment. There is also a major decrease in water consumption in the processing by elimination of pigment.

While a preferred application of the shake fabricating process of the present invention has been shown and described, it will be understood that there is no intent to limit the invention of such disclosure, but rather it is intended to cover all modifications and alternative applications falling within the spirit and scope of the invention as defined in the appended claims.

What is claimed is:

1. A shake fabricating process for producing environmentally friendly roofing shakes from a lumber drop block having a natural grain and having an upper surface and an opposed lower surface, said fabricating process comprising the steps of:

scanning the drop block for unacceptable grain structure;

cutting said drop block across said natural grain into blanks having a length generally equivalent to the length of a roofing shake and including a first end section and a second end section;

scanning the blanks for defects and cutting the blanks longitudinally along the grain as to eliminate the defects cutting said blank on a diagonal plane relative to said first and second end sections, said plane extending from said first end to said second end so as to divide said board into a pair of shakes, each shake having a first and second end portion and defining a decreasing thickness from said first end portion to said second end portion; and placing said shakes in a pressure treating chamber for treatment with a chemical preservative.

2. The shake fabricating process of claim 1 wherein said chemical preservative comprises a copper azole and dissolved copper.

3. The shake fabricating process of claim 1 wherein said unacceptable grain structure is cut from said drop block.

4. The shake fabricating process of claim 1 wherein said blank is cut longitudinally along said natural grain to form at least two vertical grain blanks.

5. The shake fabrication process of claim 1 and further comprising the step of cutting a plurality of longitudinally oriented grooves in said upper and lower surfaces of said blank, whereby said upper and lower surfaces are provided with the appearance of weathered wood grain.

6. A shake fabricating process for producing environmentally friendly roofing shakes from a lumber drop block having a natural grain and having an upper surface and an opposed lower surface, said fabricating process comprising the steps of:

scanning the drop block for unacceptable grain structure;

cutting said drop block across said natural grain into blanks having a length generally equivalent to the length of a roofing shake and including a first end section and a second end section;

cutting said blank on a diagonal plane relative to said first and second end sections, said plane extending from said first end to said second end so as to divide said board into a pair of shakes, each shake having a first and second end portion and defining a decreasing thickness from said first end portion to said second end portion; and placing said shakes in a pressure treating chamber for treatment with a chemical preservative comprising a copper azole and dissolved copper.

7. The shake fabricating process of claim 6 wherein said unacceptable grain structure is cut from said drop block.

8. The shake fabricating process of claim 6 wherein said blank is cut longitudinally along said natural grain to form at least two vertical grain blanks.

9. The shake fabrication process of claim 6 and further comprising the step of cutting a plurality of longitudinally oriented grooves in said upper and lower surfaces of said blank, whereby said upper and lower surfaces are provided with the appearance of weathered wood grain.

10. A shake fabricating process for producing environmentally friendly roofing shakes from a lumber drop block having a natural grain and having an upper surface and an opposed lower surface, said fabricating process comprising the steps of:

scanning the drop block for unacceptable grain structure;

cutting said drop block across said natural grain into blanks having a length generally equivalent to the length of a roofing shake and including a first end section and a second end section;

cutting said blank longitudinally along said natural grain to form at least two vertical grain blanks;

cutting each of said vertical grain blanks on a diagonal plane relative to said first and second end sections, said plane extending from said first end to said second end so as to divide said board into a pair of shakes, each shake having a first and second end portion and defining a decreasing thickness from said first end portion to said second end portion; and placing said shakes in a pressure treating chamber for treatment with a chemical preservative comprising a copper azole and dissolved copper.

11. The shake fabricating process of claim 10 wherein said unacceptable grain structure is cut from said drop block.

12. The shake fabrication process of claim 10 and further comprising the step of cutting a plurality of longitudinally oriented grooves in said upper and lower surfaces of said blank, whereby said upper and lower surfaces are provided with the appearance of weathered wood grain.

* * * * *